US006895633B2

(12) United States Patent
Tucker

(10) Patent No.: US 6,895,633 B2
(45) Date of Patent: May 24, 2005

(54) SQUEEGEE WITH CLOG REDUCTION STRUCTURE

(75) Inventor: Alan Wayne Tucker, Maple Grove, MN (US)

(73) Assignee: Tennant Company, Minneapolis, MN (US)

( * ) Notice: Subject to any disclaimer, the term of this patent is extended or adjusted under 35 U.S.C. 154(b) by 312 days.

(21) Appl. No.: 10/177,365

(22) Filed: Jun. 20, 2002

(65) Prior Publication Data

US 2003/0233729 A1 Dec. 25, 2003

(51) Int. Cl.[7] ..... A47L 11/30
(52) U.S. Cl. ..... 15/401; 15/320
(58) Field of Search ..... 15/320, 322, 401, 15/402

(56) References Cited

U.S. PATENT DOCUMENTS 3,065,490 A * 11/1962 Arones ..... 15/359
3,107,387 A * 10/1963 Katt ..... 15/375
3,571,841 A * 3/1971 Crouser ..... 15/401
4,006,506 A 2/1977 Burgoon ..... 15/50
4,339,841 A 7/1982 Waldhauser et al. ..... 15/359
4,363,152 A 12/1982 Karpanty ..... 15/98
4,483,041 A 11/1984 Waldhauser et al. ..... 15/359
4,619,010 A 10/1986 Burgoon ..... 15/50
5,099,545 A * 3/1992 Krasznai et al. ..... 15/344
5,377,382 A 1/1995 Bores et al. ..... 15/340.1
5,579,555 A 12/1996 Pearse ..... 15/320
2002/0006307 A1 * 1/2002 Feeny et al. ..... 403/2

* cited by examiner

*Primary Examiner*—Terrence R. Till
(74) *Attorney, Agent, or Firm*—Fulbright & Jaworski LLP

(57) ABSTRACT

A clog reduction structure for a squeegee assembly for removing solution from a floor surface with a surface maintenance vehicle. The clog reduction structure includes an inlet in fluid communication with a vacuum chamber, an outlet in fluid communication with a vacuum conduit, and a configured surface between said inlet and said outlet, wherein said inlet has a substantially larger cross sectional area than said outlet. The clog reduction structure may include a variety of shapes or transitions between the inlet and outlet of the squeegee assembly. Efficient passage of larger debris from the vacuum chamber into a vacuum conduit is provided by the clog reduction structure.

12 Claims, 5 Drawing Sheets

SQUEEGEE WITH CLOG REDUCTION STRUCTURE

FIELD OF THE INVENTION

The present invention generally relates to surface cleaning equipment. More particularly the present invention relates to a squeegee assembly having a clog reduction structure for use with such equipment. The clog reduction structure includes a configured transition between a vacuum chamber and a vacuum outlet of the squeegee assembly. The configured transition permits larger debris elements to pass into the vacuum outlet without "bridging" and creating an obstruction.

BACKGROUND OF THE INVENTION

Surface maintenance vehicles and cleaning devices have a long history subject to gradual innovation and improvement toward improved and oftentimes automated performance in removing debris and contamination from floors. These vehicles and devices may be self-powered, towed, or pushed, and/or manually powered and may carry a human operator during cleaning operations. Such vehicles and devices include scrubbers, extractors, sweepers and vacuums, as well as combinations thereof, intended for cleaning, scrubbing, wiping and/or drying a portion of a substantially flat surface both indoors and outdoors. Many such vehicles and devices employ a squeegee assembly for removing solution from a floor which has been cleaned by application of a cleaning solution of water and a detergent in conjunction with scrubbing action of one or more moving brushes. Accordingly, the squeegee assembly of such prior art cleaning vehicles often mounts at or near the rear of the surface maintenance vehicle to direct the solution to a removal location where the solution (including suspended dirt, particles and contaminants) is removed. In this disclosure, the term "loaded cleaning solution" shall apply to such a cleaning solution after application thereof to a floor or other surface to be cleaned. The cleaning solution is typically supplied to the floor surface through or near rotary scrub brushes operating from a lower portion of the vehicle. The squeegee assembly may include a squeegee supporting member of generally arcuate configuration with two squeegee blades spaced apart and affixed to the supporting member to promote consistent contact with the surface to be cleaned and wiped.

In some prior art cleaning vehicles having two squeegee blades, a vacuum source may couple to the wiping assembly to lift the loaded cleaning solution from the space between the blades to a remote reservoir or other collection unit. The squeegee assembly is often sufficiently wide to at least fully cover the path width of the scrub brushes and/or the wheels of the cleaning vehicle. In some prior art squeegee assemblies, debris may become lodged proximate to the vacuum outlet. Clogging of the squeegee assembly is particularly likely when larger debris items, such as sticks, metal shavings, etc. are found on the surface. A clogged squeegee may require time and effort to correct, adding to an overall operational inefficiency of the machine.

SUMMARY OF THE PRESENT INVENTION

The present invention teaches, enables and discloses an improved squeegee assembly usable in a surface maintenance vehicle. Such a vehicle includes those self-powered and manually powered cleaning vehicles applied to the task of removing loaded cleaning solution from a cleaned surface and preferably include all such vehicles using an articulated squeegee assembly; although rigid or fixed squeegee assemblies for such vehicles benefit from the teaching of this disclosure. Such a surface may comprise an interior or exterior floor having some limited porosity but preferably comprising finished concrete (whether painted or sealed), asphalt, ceramic tile, resin-based tile, and the like and including most types of flooring typical of commercial and industrial-grade facilities. However, the teaching hereof finds application in diverse handling of fluids, whether or not "loaded," naturally-occurring liquid(s) or pure cleaning fluid.

One object of the present invention is to provide a squeegee assembly having a clog reduction structure. In one embodiment of the present invention the clog reduction structure includes a configured transition between the vacuum chamber and vacuum outlet of the squeegee assembly.

Another object of the invention is to minimize squeegee clogging and eliminate the time and effort needed to correct a clogged squeegee.

These and other objects, features and advantages will become apparent in light of the following detailed description of the preferred embodiments in connection with the drawings. Those skilled in the relevant art will readily appreciate that these drawings and embodiments are merely illustrative and not intended to limit the true spirit and scope of the invention disclosed, taught and enabled herein.

BRIEF DESCRIPTION OF THE DRAWINGS

Preferred embodiments of the invention will be described in detail hereinafter with reference to the accompanying drawings, in which like reference numerals refer to like elements throughout.

DETAILED DESCRIPTION OF PREFERRED EMBODIMENTS

Figure 1:
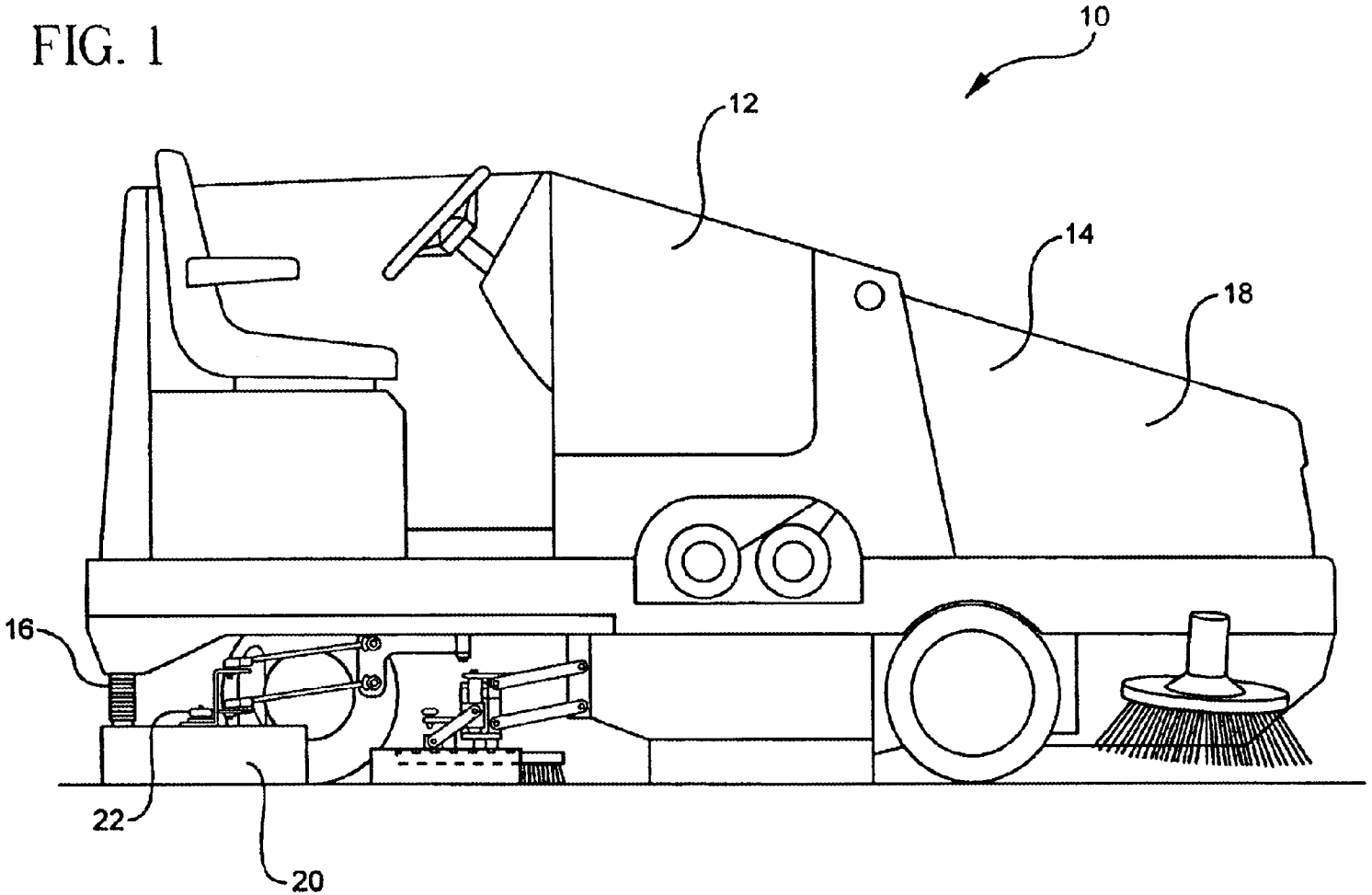
FIG. 1 is an elevational side view of an exemplary self-propelled surface maintenance vehicle employing an embodiment of the squeegee assembly having a vacuum source fluidly coupled thereto and wherein a human user controls and operates the vehicle from an integrated operator station disposed on and near the rear of the vehicle so that when the vehicle is propelled forward during cleaning the squeegee assembly completes a final step comprising wiping the surface and evacuating loaded cleaning solution via the vacuum source.
Figure 2:
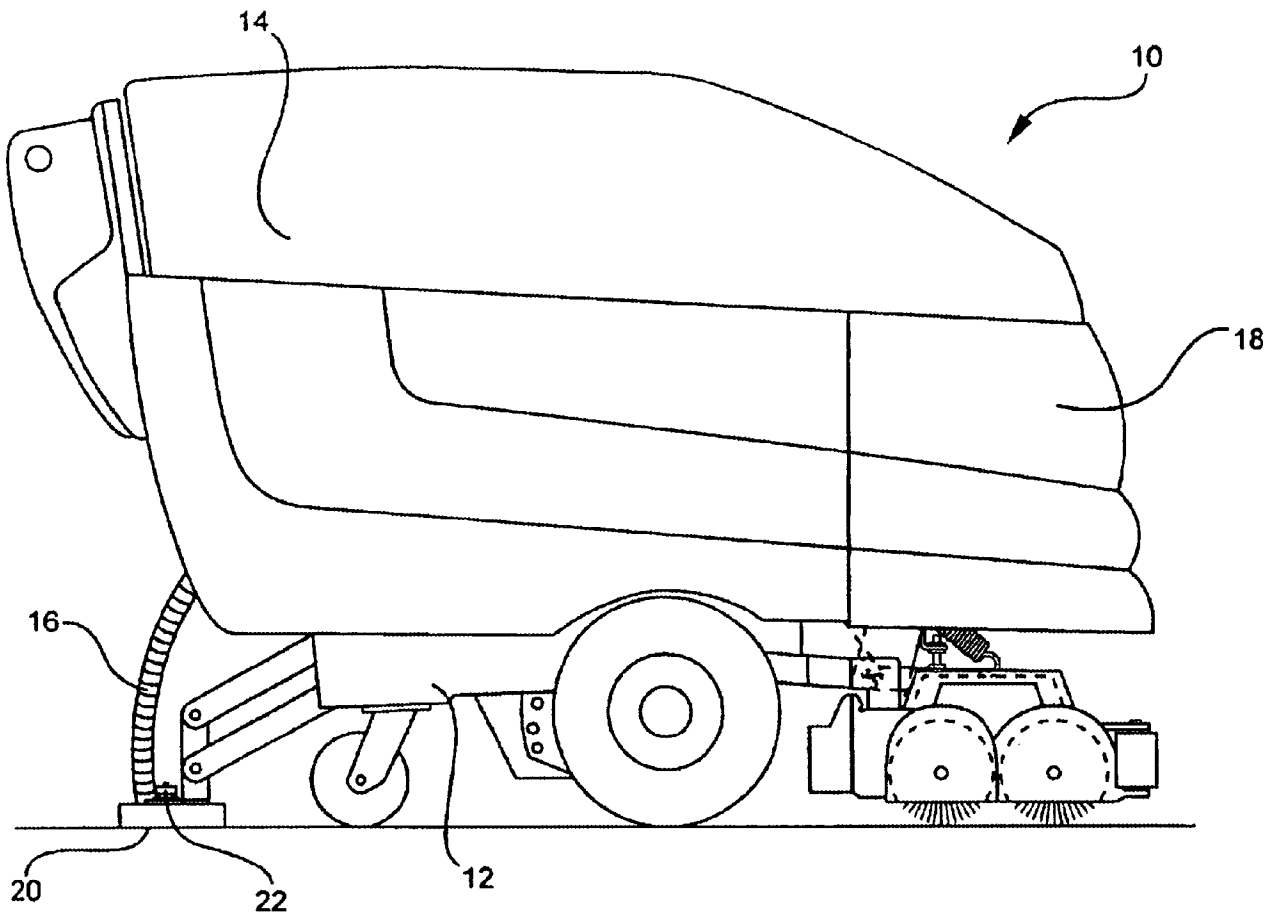
FIG. 2 is an elevational side view of an exemplary surface maintenance vehicle employing an embodiment of the articulated squeegee assembly and wherein a human user controls and operates the vehicle while walking behind the vehicle.

Industrial sweeper-scrubbers which may use the present invention are shown in FIGS. 1 and 2. These surface maintenance machines may be used for sweeping and/or scrubbing floors in factories, warehouses, and other industrial or commercial establishments. As shown in FIG. 1, a riding-type surface maintenance vehicle 10 has a frame 12, and is supported on a plurality of front and rear wheels. Typically, such a surface maintenance vehicle 10 includes a variety of implements such as brushes and systems for dispensing cleaning solutions typically composed of detergent and water which suspend dirt. Vehicle 10 includes a vacuum system including a vacuum fan 14, and a vacuum hose 16 in fluid communication with a recovery tank 18. Herein, a cleaning solution containing suspended dirt and other particles shall be called a "loaded cleaning solution." Loaded cleaning solution and other liquid material are usually removed by squeegee assembly 20. Squeegee assembly 20 is mechanically coupled near the rear of a surface maintenance vehicle 10. Squeegee assembly 20 may be operatively connected to the surface maintenance vehicle 10 by a releasable attachment device 22 such as disclosed in U.S. patent application Ser. No. 09/836,020, incorporated in its entirety by reference herein. One example of such a surface maintenance vehicle is disclosed in U.S. Pat. No. 5,455,985, incorporated in its entirety by reference herein.

Alternatively, FIG. 2 illustrates a walk-behind surface maintenance vehicle, such a floor scrubbing vehicle disclosed in U.S. Pat. No. 5,483,718, incorporated herein by reference in its entirety. As with the above-mentioned riding-type surface maintenance vehicle, the walk behind surface maintenance vehicle 10 includes variety of implements such as brushes and is capable of applying cleaning solutions. Vehicle 10 includes a vacuum fan 14, a recovery tank 18, and a vacuum conduit 16 providing fluid communication between squeegee assembly 22 and recovery tank 18. Again, loaded cleaning solution and other liquid material are usually removed by an articulated squeegee assembly 20 located at rear of the surface maintenance vehicle 10. And again, such an articulated squeegee assembly 20 is operatively connected to the surface maintenance vehicle 10 by a releasable attachment device 20.

Figure 3:
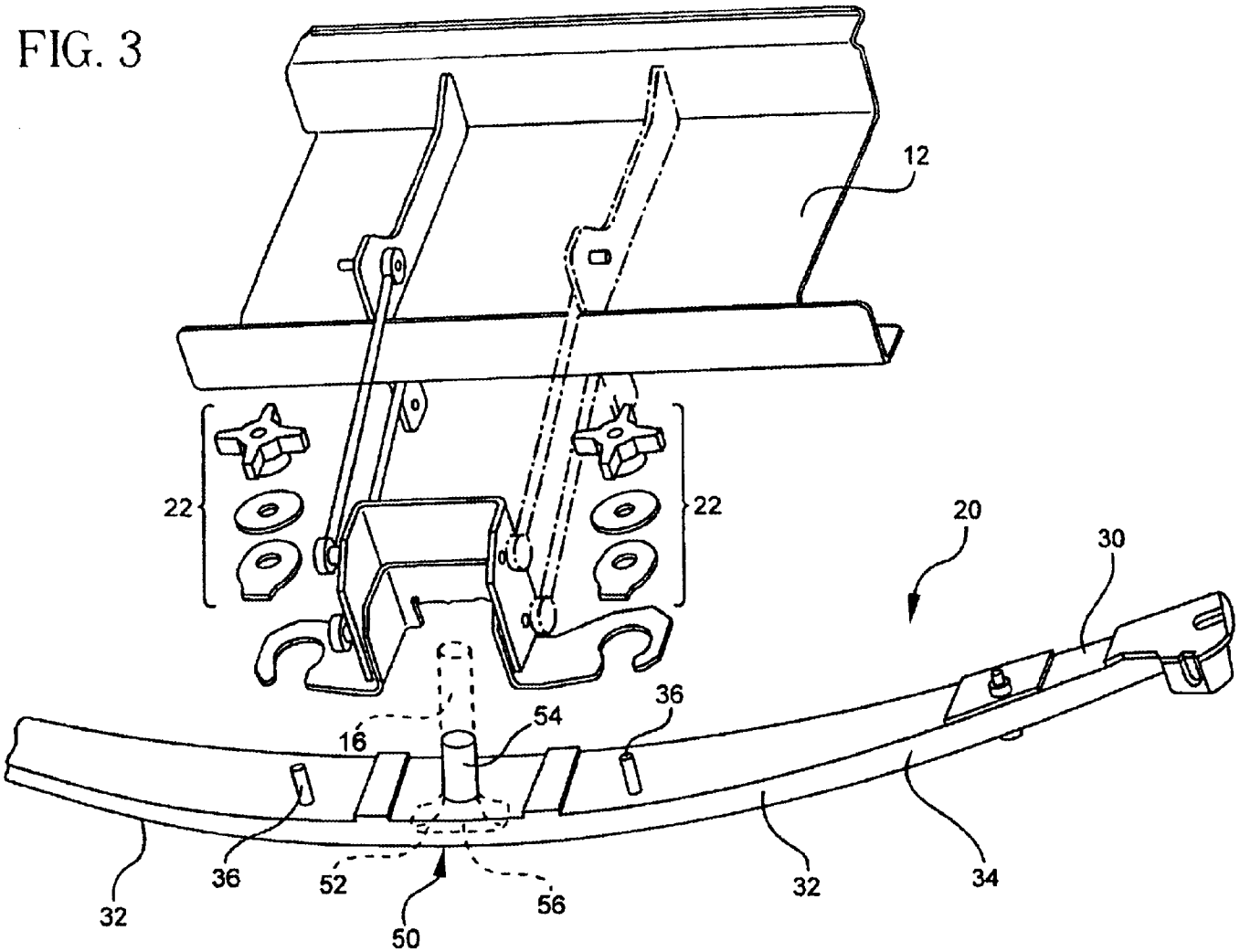
FIG. 3 is an exploded perspective view of the squeegee assembly.

Referring to FIG. 3, the squeegee assembly 20 may be operatively and releasably connected to the frame 12 of a surface maintenance machine 10 by an attachment device 22. Squeegee assembly 20 includes a frame 30 of generally arcuate or shallow v-shaped configuration with spaced squeegee blades or flexible squeegees 32 depending therefrom for contact with the surface. A vacuum chamber 34 is defined between frame 30, squeegees 32, and the floor surface. Frame 30 includes a pair of fastening elements or shanks 36 for connection with device 22. A vacuum source (not shown) in fluid communication with vacuum chamber 34 lifts the loaded cleaning solution from the surface. A clog reduction structure 50 is provided between vacuum chamber 34 and vacuum conduit 16.

Figure 4:
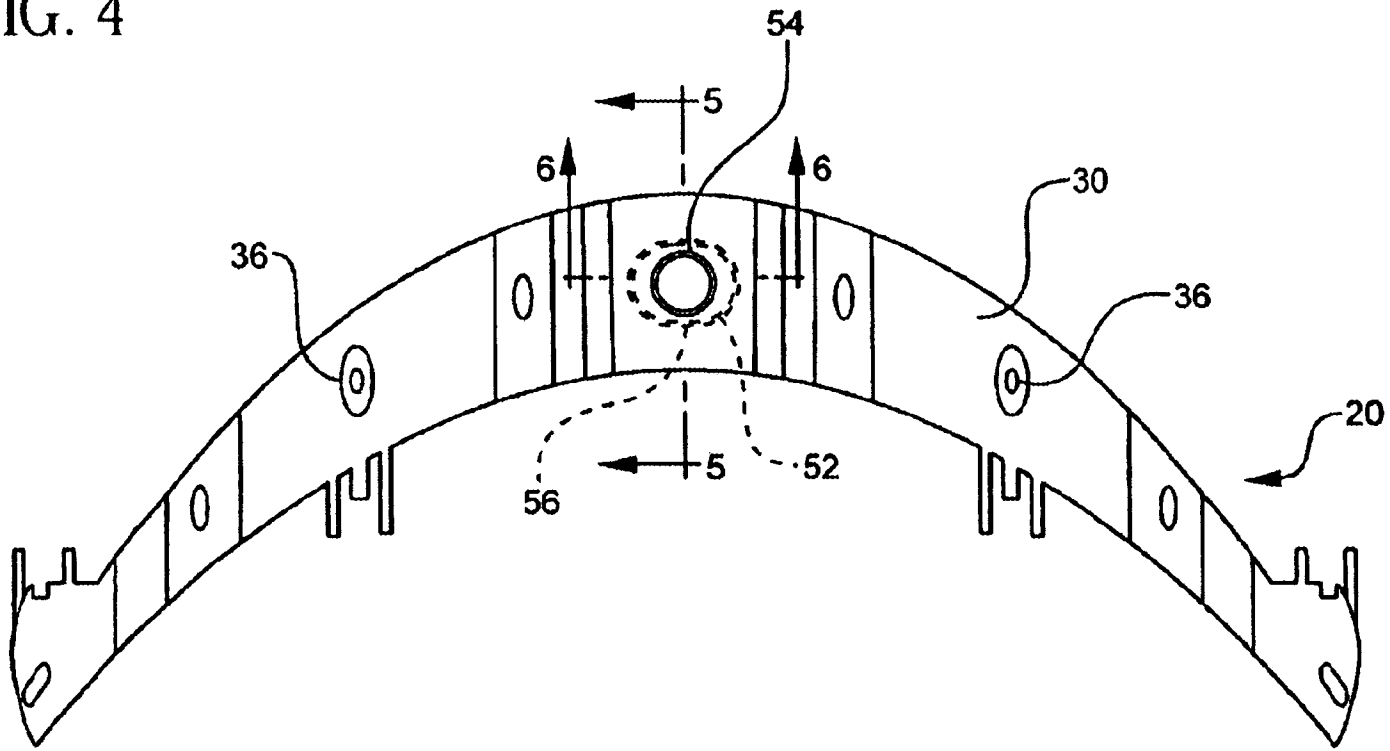
FIG. 4 is a top plan view of a squeegee frame.
Figure 6:
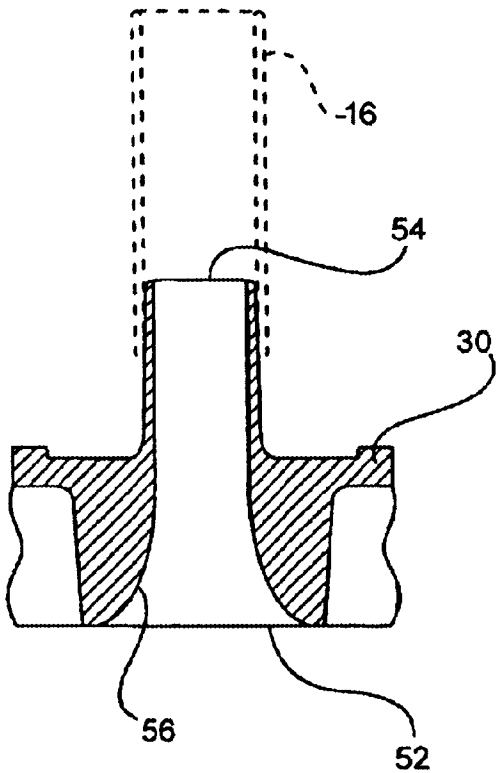
FIG. 6 is a section view B—B from FIG. 4 according to the present invention.
Figure 5:
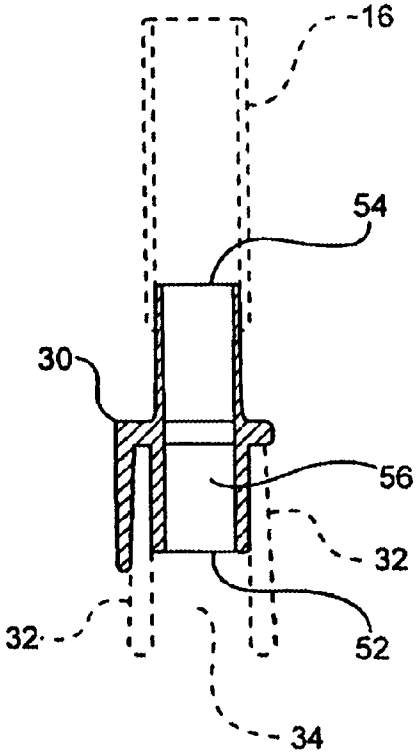
FIG. 5 is a section view A—A from FIG. 4 according to the present invention.

Referring particularly to FIGS. 4 through 6, one embodiment of clog reduction structure 50 includes an inlet orifice 52 to vacuum chamber 34 and an outlet orifice 54 for connection to vacuum conduit 16. As shown in FIG. 4, outlet 54 in the exemplary embodiment is generally oval shaped. Between inlet 52 and outlet 54 is a configured transition surface 56. In the illustrated embodiment, configured surface 56 is a generally smooth geometric transition from inlet 52 to outlet 54. Configured surface 56 may also be characterized as a narrowing structure between inlet 52 and outlet 54. In other words, inlet 52 and outlet 54 each have an associated cross sectional area taken in a plane generally perpendicular to the plane of FIGS. 5 and 6. Outlet 54 area is approximately one-third the size of inlet area 52. Configured surface 56 may also be characterized as a having a bell or horn shape. Configured surface 56 permits relatively large pieces of debris to turn from vacuum chamber 34 and pass into vacuum conduit 16 without creating an obstruction.

In the illustrated embodiment, clog reduction structure 50 is an integrated portion of squeegee frame 30. In alternative embodiments, clog reduction structure 50 may be separate part which is connected between squeegee frame 30 and vacuum conduit 16. In alternative embodiments, inlet 52 and outlet 54 may assume different shapes, including but not limited to circular or semi-circular forms. Configured surface 56, which in the illustrated embodiment is a generally smooth transition from inlet 52 to outlet 54, may assume a variety of different shapes all toward transitioning inlet 52 to outlet 54 to accommodate larger debris than previously possible.

Additional advantages and modifications will readily occur to those skilled in the art upon reflection on the teaching, written disclosure and illustrations herein. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A squeegee assembly for removing solution from a floor surface with a surface maintenance vehicle, said squeegee assembly comprising:

a squeegee frame member;

a pair of deformable squeegee members coupled to the squeegee frame member which together define at least a portion of a vacuum chamber; and a clog reduction structure having an inlet in fluid communication with the vacuum chamber, an outlet in fluid communication with a vacuum conduit having a predetermined cross sectional area taken in a plane generally perpendicular to a direction of elongation, and a configured surface between said inlet and said outlet, wherein said inlet is generally circular and has a substantially larger cross sectional area than said outlet, and wherein the configured surface maintains a cross sectional area, taken in a plane generally perpendicular to the pair of squeegee members, which is equal to or greater than the predetermined cross sectional area of the vacuum conduit.

2. The squeegee assembly of claim 1, when the clog reduction structure is integrated with the squeegee frame member as a single unit.

3. The squeegee assembly of claim 1, wherein the inlet and outlet of the clog reduction structure are differently configured.

4. The squeegee assembly of claim 1, wherein the configured surface provides a generally smooth transition between the inlet and the outlet of the clog reduction structure.

5. A squeegee assembly for removing solution for removing solution from a floor surface with a surface maintenance vehicle, said squeegee assembly comprising:

a squeegee frame member, a pair of deformable squeegee members coupled to the squeegee frame member which together define at least a portion of a vacuum chamber;

an inlet orifice upon the squeegee frame member, said inlet orifice being generally circular and in fluid communication with the vacuum chamber through a vacuum conduit, said vacuum conduit having a predetermined cross sectional area taken in a plane generally perpendicular to a direction of elongation;

an outlet orifice upon the squeegee frame member, said outlet orifice in fluid communication with the inlet orifice; and a transition surface extending upwardly and inwardly from the inlet orifice so that the inlet orifice is substantially smaller than the outlet orifice, and wherein the transition surface maintains a cross sectional area, taken in a plane generally perpendicular to the pair of squeegee members, which is equal to or greater than the predetermined cross sectional area of the vacuum conduit.

6. The squeegee assembly of claim 5, wherein the inlet orifice and outlet orifice are differently configured.

7. The squeegee assembly of claim 5, wherein the transition surface provides a generally smooth transition between the inlet orifice and the outlet orifice.

8. The squeegee assembly of claim 7, wherein the transition surface is generally horn shaped.

9. A squeegee assembly for removing solution from a floor surface with a surface maintenance vehicle, said squeegee assembly comprising:

a squeegee frame member;

a pair of deformable squeegee members coupled to the squeegee frame member which together define at least a portion of a vacuum chamber;

an inlet orifice upon the squeegee frame member, said inlet orifice being generally circular and in fluid communication with the vacuum chamber through a generally circular vacuum conduit having a predetermined cross sectional area;

an outlet orifice upon the squeegee frame member, said outlet orifice in fluid communication with the inlet orifice; and a narrowing surface tending upwardly and inwardly from the inlet orifice toward the outlet orifice, said narrowing surface maintaining a cross sectional area, taken in a plane perpendicular to the pair of squeegee members, which is greater than the predetermined cross sectional area of the vacuum conduit.

10. The squeegee assembly of claim 9, wherein the inlet orifice and outlet orifice are differently sized.

11. The squeegee assembly of claim 9, wherein the transition surface provides a generally smooth transition between the inlet orifice and the outlet orifice.

12. The squeegee assembly of claim 9, wherein the outlet orifice is generally circular.

* * * * *

UNITED STATES PATENT AND TRADEMARK OFFICE

CERTIFICATE OF CORRECTION

PATENT NO. : 6,895,633 B2
DATED : May 24, 2005
INVENTOR(S) : Tucker, Alan W.

It is certified that error appears in the above-identified patent and that said Letters Patent is hereby corrected as shown below:

Column 4,
Line 42, delete “when” and insert -- wherein --.

Signed and Sealed this

Twenty-third Day of August, 2005

JON W. DUDAS
*Director of the United States Patent and Trademark Office*